US009261016B2

(12) United States Patent
Uesugi et al.

(10) Patent No.: US 9,261,016 B2
(45) Date of Patent: Feb. 16, 2016

(54) VARIABLE GEOMETRY TURBOCHARGER AND FLOW RATE ADJUSTMENT METHOD FOR THE SAME

(71) Applicant: KABUSHIKI KAISHA TOYOTA JIDOSHOKKI, Kariya-shi, Aichi-ken (JP)

(72) Inventors: Tsuyoshi Uesugi, Kariya (JP); Hiromu Iwata, Kariya (JP); Kenta Akimoto, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 158 days.

(21) Appl. No.: 13/692,625

(22) Filed: Dec. 3, 2012

(65) Prior Publication Data

US 2013/0152583 A1 Jun. 20, 2013

(30) Foreign Application Priority Data

Dec. 14, 2011 (JP) ..... 2011-273561

(51) Int. Cl.
*F01D 17/16* (2006.01)
*F02B 37/24* (2006.01)
*F02D 41/26* (2006.01)

(52) U.S. Cl.
CPC ..... *F02B 37/24* (2013.01); *F01D 17/165* (2013.01); *F02D 41/263* (2013.01); *F05D 2220/40* (2013.01)

(58) Field of Classification Search
CPC ..... F01D 17/165; F02B 37/24; F02D 41/263; F05D 2220/40
USPC ..... 60/602; 701/102
See application file for complete search history.

(56) References Cited

U.S. PATENT DOCUMENTS 7,805,938 B2 10/2010 Roh
2002/0189254 A1* 12/2002 Shirakawa ..... 60/602
(Continued)

FOREIGN PATENT DOCUMENTS

EP 1 304 462 A2 4/2003
EP 1 491 744 A1 12/2004
(Continued)

OTHER PUBLICATIONS

Extened European Search Report issued Jun. 24, 2014 in European Patent Application 12193348.5.
(Continued)

*Primary Examiner* — Jorge Pereiro
*Assistant Examiner* — Paul Thiede
(74) *Attorney, Agent, or Firm* — Sughrue Mion, PLLC

(57) ABSTRACT

A flow rate adjustment method for a variable geometry turbocharger may include steps as follows. An adjustment apparatus drives an actuator to an abutment position where a power transmission member abuts a stopper. The apparatus acquires the abutment position opening amount based on an opening detection sensor's signal. The apparatus drives the actuator until the detection amount attains a pre-set amount, moving the power transmission member to a temporary control position. The apparatus acquires a temporary control position flow rate. It is acquired when an adjustment gas inflow apparatus causes the adjustment gas to flow into an exhaust turbine, and a flow rate measurement sensor measures the flow rate of the adjustment gas. The apparatus obtains a correction amount based on a difference between the temporary control position flow rate and a real control position flow rate, which is a proper flow rate corresponding to the pre-set amount.

2 Claims, 9 Drawing Sheets

(56) References Cited

U.S. PATENT DOCUMENTS

| | | | | |
|---|---|---|---|---|
| 2005/0022524 | A1* | 2/2005 | Ando et al. | 60/602 |
| 2006/0047397 | A1* | 3/2006 | Buchanan et al. | 701/51 |
| 2009/0151351 | A1 | 6/2009 | Zurawski et al. | |

FOREIGN PATENT DOCUMENTS

| | | | |
|---|---|---|---|
| JP | 2002-038964 | A | 2/2002 |
| JP | 2002-256877 | A | 9/2002 |
| JP | 2005-083295 | A | 3/2005 |
| JP | 2008-075635 | A | 4/2008 |
| JP | 2010-223035 | A | 10/2010 |
| JP | 2010-223201 | A | 10/2010 |
| JP | 2010-270631 | A | 12/2010 |

OTHER PUBLICATIONS

Communication dated Apr. 30, 2015 from the European Patent Office in counterpart European Application No. 12193348.5.

European Search Report issued Feb. 11, 2015 in European Patent Application No. 12 193 348.5.

* cited by examiner

VARIABLE GEOMETRY TURBOCHARGER AND FLOW RATE ADJUSTMENT METHOD FOR THE SAME

This application claims priority to Japanese patent application serial number 2011-273561, the contents of which are incorporated herein by reference.

BACKGROUND OF THE INVENTION

1. Field of the Invention

The present invention relates to a variable geometry turbocharger having a variable nozzle configured to adjust opening of a flow path for exhaust gas.

2. Description of the Related Art

Turbochargers are disclosed in Japanese Laid-Open Patent Publication No. 2010-270631, Japanese Laid-Open Patent Publication No. 2002-38964, and Japanese Laid-Open Patent Publication 2002-256877. The turbocharger utilizes exhaust gas in order to rotate a turbine and supercharge intake air. This helps to improve the output characteristics of an engine. A variable nozzle is provided in a flow path communicating between an inflow inlet for exhaust gas and an exhaust turbine. The variable nozzle is driven by an actuator according to the RPM of the engine, the amount of exhaust gas, etc., for adjusting an opening of the flow path. As a result, nevertheless there is low rotation in the engine, and the amount of exhaust gas is small, the flow velocity of the exhaust gas can be increased. In this way, it is possible to secure an appropriate turbine RPM, so as to provide an appropriate supercharging pressure.

It should be noted, however, that the turbocharger, in which a driving force is transmitted from the actuator to the variable nozzle, involves a large number of components. Thus, an error is generated in the opening of the variable nozzle due to dimensional errors and mounting errors of the components.

Japanese Laid-Open Patent Publication No. 2010-270631 discloses a variable geometry turbocharger. The variable geometry turbocharger has a torque control means for controlling the output torque of an internal combustion engine. The torque control means has a learning means. The learning means learns the turbocharger individual differences based on the condition of the supercharging pressure. The learning means performs learning such that when the change in the supercharging pressure in a transient stage of the turbocharger is larger than a standard amount, the initial value of the torque control value increases. This helps to suppress the generation of an inadvertent difference in torque level. The learning means performs learning such that when the change in the supercharging pressure in the transient stage is smaller than a standard amount, the initial value of the torque control value decreases. In this way, unnecessary torque control is avoided.

It should be noted, however, that the learning means performs learning after the operation in the transient stage of the turbocharger. Thus, until the learning is completed, there is the possibility of a difference in torque level due to the turbocharger individual differences being generated.

Japanese Laid-Open Patent Publication No. 2002-38964 discloses a method of mounting a turbocharger with a variable nozzle vane. By this method, it is possible to attach a plurality of variable nozzles easily and securely. By this method, it is possible to achieve a reduction in variable nozzle mounting errors. However, since the number of power transmission members transmitting drive force from the actuator to the variable nozzle is large, it is not easy to sufficiently lower the dimensional and mounting errors of these members.

Japanese Laid-Open Patent Publication No. 2002-256877 discloses a nozzle opening regulation apparatus of a variable nozzle mechanism and a method of manufacturing the same. The apparatus or the manufacturing method helps to simplify the opening and closing of the variable nozzle. Thus, it is possible to reduce the assembly man-hours, adjustment operation man-hours, assembly cost, and adjustment operation cost of the variable nozzle mechanism. It is possible to simplify the structure for setting the fully open position and fully closed position, thus achieving a reduction in component cost. However, the number of power transmission members for transmitting the driving force from the actuator to the variable nozzle is rather large. Thus, it is not easy to sufficiently reduce the dimensional and mounting errors of these members.

Thus, there has been a need for a variable geometry turbocharger capable of sufficiently reducing the errors mentioned above.

SUMMARY OF THE INVENTION

One feature of the present invention lies in a flow rate adjustment method for the variable geometry turbocharger for adjusting the opening of the variable nozzle. The variable geometry turbocharger includes an exhaust turbine, an intake turbine, a variable nozzle, an actuator, a power transmission member, a stopper, and an opening detection sensor. The variable nozzle adjusts the opening of an exhaust gas flow path with respect to the exhaust turbine. The actuator drives the variable nozzle. The power transmission member transmits driving force of the actuator to the variable nozzle. The stopper is provided at a position where the stopper abuts the power transmission member when the variable nozzle is driven. The opening detection sensor detects the opening of the variable nozzle.

The flow rate adjustment method for the variable geometry turbocharger has a plurality of steps. In one step, an adjustment apparatus drives the actuator to an abutment position where the power transmission member abuts the stopper. When the power transmission member is at the abutment position, the adjustment apparatus acquires and stores the abutment position opening amount based on a detection signal from the opening detection sensor. In the next step, the adjustment apparatus drives the actuator until the detection amount based on the detection signal from the opening detection sensor attains a pre-set temporary control position opening amount. This causes the movement of the power transmission member to a temporary control position. In the next step, the adjustment apparatus acquires and stores a temporary control position flow rate, which is the flow rate of the adjustment gas when the power transmission member is at the temporary control position. In this step, an adjustment gas inflow apparatus, for causing the adjustment gas to flow into the exhaust turbine, and a flow rate measurement sensor, for measuring the flow rate of the adjustment gas are used. In the next step, the adjustment apparatus obtains a correction amount based on a difference between the temporary control position flow rate measured and a real control position flow rate. The real control position flow rate is a proper flow rate corresponding to the pre-set temporary control position opening amount.

As a result, it is possible to appropriately adjust the flow rate in the turbocharger. For example, drive components related to the driving of the variable nozzle include a power transmission member provided between the actuator and the variable nozzle. The drive components exhibit a combined error which is the sum total of dimensional errors and mounting errors of all the members. According to the present flow rate adjustment method, it is possible to appropriately cancel the combined error to appropriately adjust the flow rate in the turbocharger.

The present flow rate adjustment method can be executed at the time of the production of the variable geometry turbocharger. Thus, there is no need to detect the change in the supercharging pressure when the turbocharger is being operated. It is possible to avoid from the first inadvertent generation of difference in engine torque level. Alternatively, it is possible to avoid unnecessary torque control.

Another feature of the present invention lies in a variable geometry turbocharger flow rate adjustment method. The variable geometry turbocharger flow rate adjustment method has a plurality of other steps. In one step, an adjustment apparatus drives the actuator to an abutment position where the power transmission member abuts the stopper. When the power transmission member is at the abutment position, the adjustment apparatus acquires and stores an abutment position opening amount based on a detection signal from the opening detection sensor. In the next step, the adjustment apparatus drives the actuator until a flow rate measured by the flow rate measurement sensor attains a flow rate. This flow rate corresponds to a pre-set temporary control position opening amount. It uses an adjustment gas inflow apparatus for causing an adjustment gas to flow into the exhaust turbine, and a flow rate measurement sensor for measuring the flow rate of the adjustment gas. Using these features, the adjustment apparatus can move the power transmission member to a real control position. The adjustment apparatus acquires and stores a real control position opening amount based on a detection signal from the opening detection sensor when the power transmission member is at the real control position. In the next step, the adjustment apparatus obtains a correction amount based on a difference between the pre-set temporary control position opening amount and the real control position opening amount.

BRIEF DESCRIPTION OF THE DRAWINGS

FIGS. 4A-4D show the same views as the prior procedure shown in FIGS. 6A-6D;

DETAILED DESCRIPTION OF THE INVENTION

Figure 1:
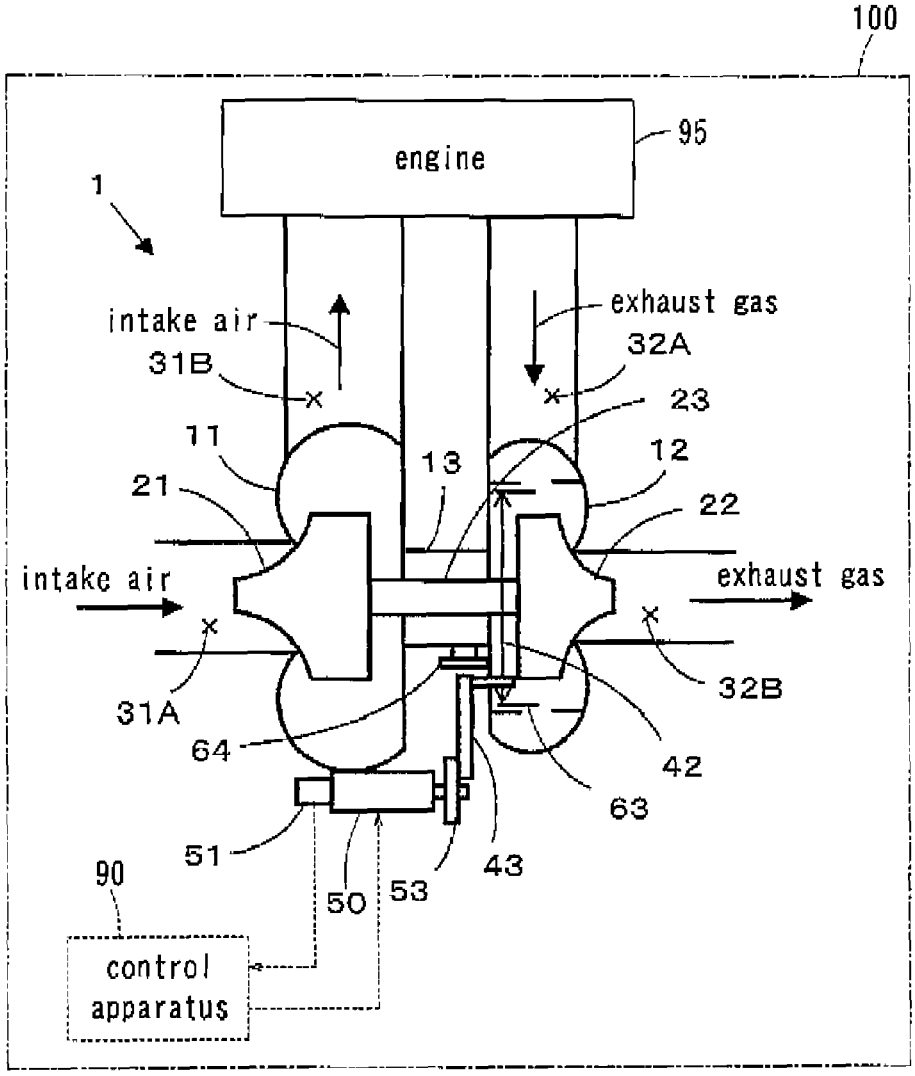
FIG. 1 is a schematic view of an embodiment of a variable geometry turbocharger.

Each of the additional features and teachings disclosed above and below may be utilized separately or in conjunction with other features and teachings to provide improved variable geometry turbochargers. Representative examples of the present invention, which utilize many of these additional features and teachings both separately and in conjunction with one another, will now be described in detail with reference to the attached drawings. This detailed description is merely intended to teach a person of ordinary skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful configurations of the present teachings.

An overall structure of a variable geometry turbocharger 1 will be described with reference to FIG. 1. The variable geometry turbocharger 1 has a turbine shaft 23, an intake turbine 21, an exhaust turbine 22, an intake housing 11, an exhaust housing 12, a bearing housing 13, and a variable nozzle 63. There is provided an actuator 50 for driving the variable nozzle 63, and power transmission members 53, 43, and 42, and an opening sensor 51 for detecting an opening in the variable nozzle 63 (operating amount of the actuator 50). The intake turbine 21 is provided at one end in the axial direction of the turbine shaft 23. The exhaust turbine 22 is provided at the other end of the turbine shaft 23.

The intake air housing 11 covers an outer periphery of the intake turbine 21, and has an intake air inflow port 31A and an intake air outflow port 31B. Air is passed through an air cleaner or the like, and flows into the intake housing 11 from the intake air inflow port 31A. The air is pressurized in the intake turbine 21, and is discharged towards an engine 95 from the intake air outflow port 31B.

The exhaust housing 12 covers a periphery of the exhaust turbine 22, and has an exhaust gas inflow port 32A and an exhaust gas outflow port 32B. Exhaust gas from the engine 95 flows into the exhaust housing 12 through the exhaust air inflow port 32A. After being used to rotate the exhaust turbine 22, the exhaust gas is discharged towards a purification apparatus or the like from the exhaust gas outflow port 32B.

The bearing housing 13 rotatably supports the turbine shaft 23, and covers the periphery of the turbine shaft 23. One end of the bearing housing 13 is connected to the intake housing 11, while the other end is connected to the exhaust housing 12.

The variable nozzle 63 is provided inside the exhaust housing 12. The variable nozzle 63 adjusts the opening of the flow path connecting the exhaust gas inflow port 32A and the exhaust turbine 22. Generally speaking, the variable nozzle 63 opens wide when the rotation of the engine is relatively high and the flow rate of the exhaust gas is high. This lowers the flow velocity of the exhaust gas and reduces the RPM of the turbine shaft 23. The variable nozzle opens to a small degree when the rotational speed of the engine is relatively slow and the flow rate of the exhaust gas is low. Because the opening of the variable nozzle is small, the flow velocity of the exhaust gas increases, thereby increasing the RPM of the turbine shaft 23. This helps to secure the requisite pressurization performance of the intake turbine 21.

The actuator 50 is provided on the intake housing 11 and includes, for example, an electric motor. The actuator 50 drives the variable nozzle 63 via the power transmission members 53, 43, and 42. The opening detection sensor 51 detects the opening of the variable nozzle 63. The opening detection sensor 51 detects, for example, the operating amount (rotation angle or the like) of the actuator 50 to indirectly detect the opening of the variable nozzle 63.

Figure 2:
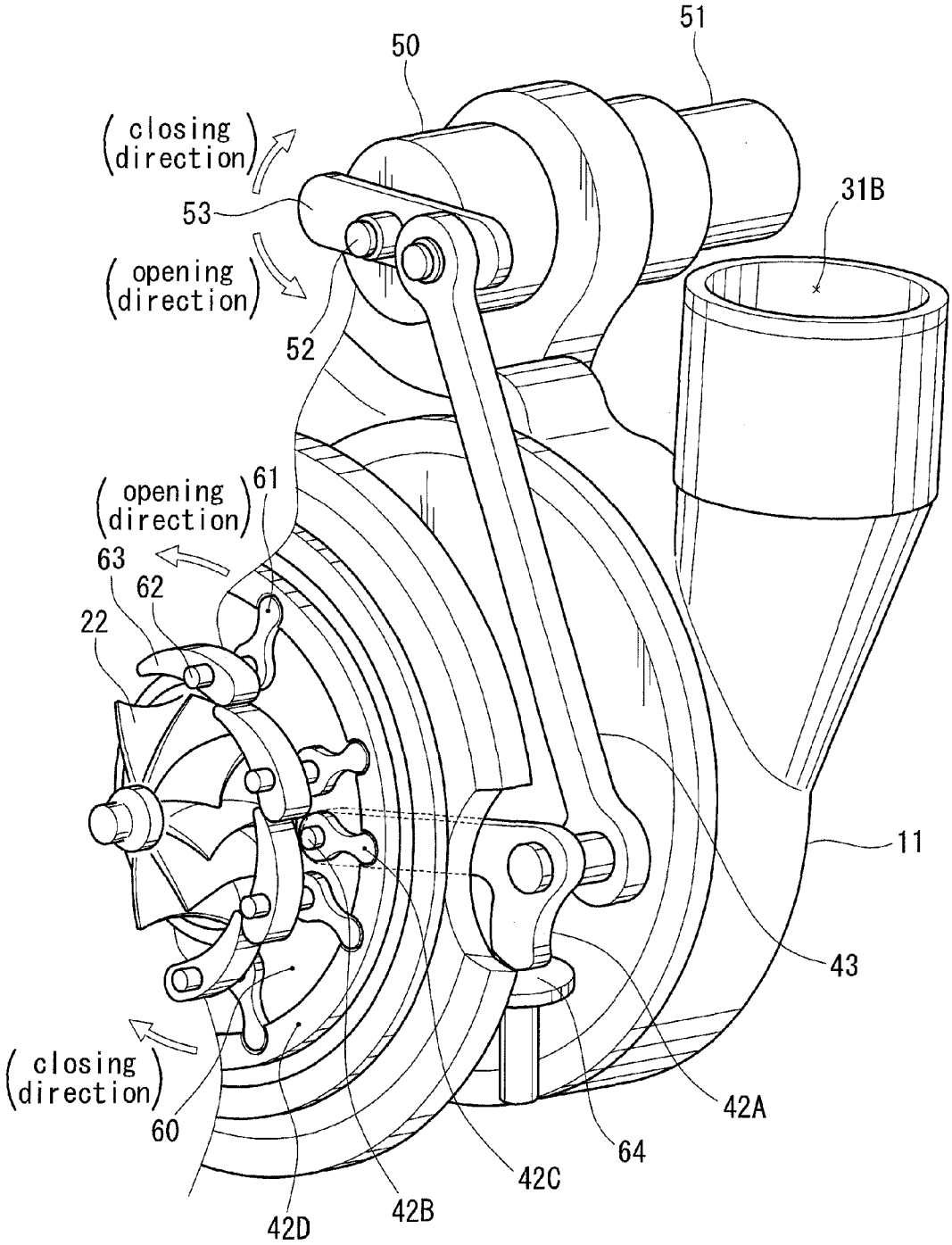
FIG. 2 is a perspective view of a part of the variable geometry turbocharger for showing a stopper and power transmission members.

As shown in FIG. 2, the power transmission member 42 includes an arm 42A, a support shaft 42B, a main arm 42C, a drive outer ring 42D, and a sub arm 61. In FIG. 2, in order to illustrate the power transmission members and the variable nozzle 63, the exhaust housing 12 is omitted and a support body 60 is partially cut out.

The power transmission member 53 is mounted to a drive shaft 52 of the actuator 50, and rotates together with the drive shaft 52. One end of the power transmission member 43 is connected to the power transmission member 53. One end of the arm 42A is connected to the other end of the power transmission member 43. The support shaft 42B at the other end of the arm 42A is supported by a support body 60. The arm 42A can rotate around the support shaft 42B. The main arm 42C is mounted to the support shaft 42B. When the arm 42A rotates, the main arm 42C rotates together with the arm 42A. An end portion of the main arm 42C is engaged with a recess of the drive outer ring 42D.

The drive outer ring 42D is provided so it can be rotated with respect to the support member 60. A plurality of recesses are formed in the drive outer ring 42D, and end portions of sub arms 61 are engaged with the recesses.

A support shaft 62 is mounted to each sub arm 61. The support shafts 62 are rotatably supported by the support body 60. The each variable nozzle 63 is mounted to each support shaft 62.

When the drive shaft 52 of the actuator 50 rotates in an opening direction, the drive outer ring 42D rotates in an opening direction, and the variable nozzles 63 rotate, resulting in an increase in the gaps (openings) between the adjacent variable nozzles 63. When the drive shaft 52 of the actuator 50 rotates in a closing direction, the drive outer ring 42D rotates in a closing direction, and the variable nozzles 63 rotate, resulting in a reduction in the gaps (openings) between the adjacent variable nozzles 63.

A stopper 64 is situated such that when the variable nozzles 63 are driven in a closing direction, a power transmission member, e.g., the arm 42A abuts the stopper 64. The stopper 64 regulates the rotation of the arm 42A when the actuator 50 rotates in the closing direction. The opening amount of the variable nozzles 63 is controlled based on the position where the stopper 64 and the arm 42A abut each other.

Figure 3:
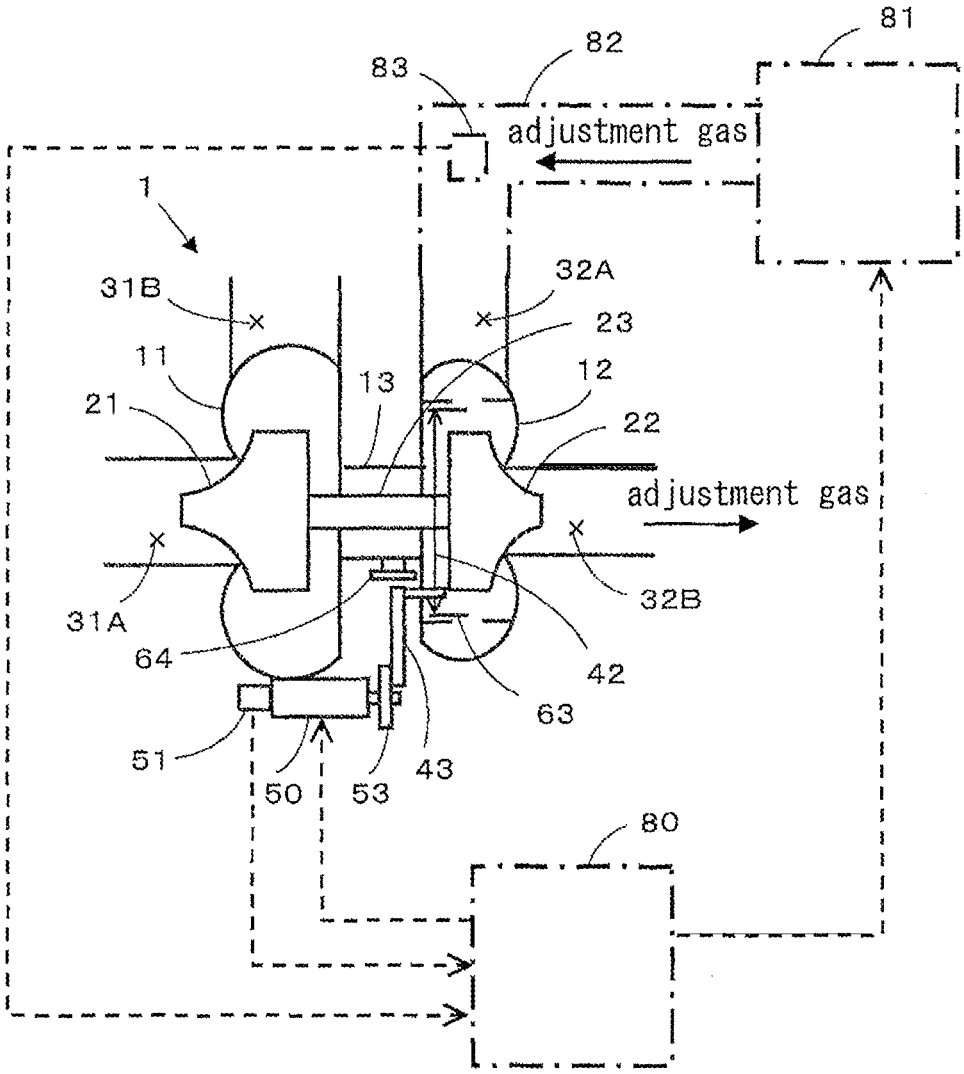
FIG. 3 is a schematic view for showing an adjustment gas inflow apparatus, a flow rate measurement sensor and an adjustment apparatus for adjusting the flow rate of the variable geometry turbocharger.

Various power transmission members, such as one or more connecting rods 42*a*, 43, may be positioned and/or oriented as needed to couple with and/or connect the actuator 50 to the variable nozzles 63, as shown in FIGS. 1 and 2. Thus, in an embodiment, the variable geometry turbocharger 1 may exhibit error, such as an intrinsic combined error, as potentially caused by, for example, dimensional errors and/or mounting errors of the components described above and may thus exceed, in some cases, a permissible error, i.e. a tolerance and/or a pre-determined threshold. As shown in FIG. 3, an adjustment apparatus 80, an adjustment gas inflow apparatus 81, and a flow rate measurement sensor 83 are connected to the variable geometry turbocharger 1 in order to cancel and/or rectify any resultant error as caused by that described above.

As shown in FIG. 3, one end of a duct 82 is connected to the exhaust gas inflow port 32A, and the other end of the duct 82 is connected to the adjustment gas inflow apparatus 81.

The adjustment gas inflow apparatus 81 supplies gas through the duct 82 for making an adjustment to a predetermined temperature and a predetermined pressure in the exhaust gas inflow port 32A of the variable geometry turbocharger 1. Provided in the duct 82 is a flow rate measurement sensor 83 for detecting the flow rate of the adjustment gas.

A detection signal from the opening detection sensor 51 and a detection signal from the flow rate measurement sensor 83 are input to the adjustment apparatus 80. The adjustment apparatus 80 outputs a drive signal for driving the actuator 50 and a drive signal for driving the adjustment gas inflow apparatus 81.

For comparison, a conventional flow rate adjustment method will be described with reference to FIGS. 6A to 6E. Conventionally, the intrinsic combined error has been canceled through fine adjustment of the position of a stopper 164. The conventional stopper 164 has an adjustment structure for adjusting the position where the stopper 164 abuts an arm 42A, and a sealing structure for preventing a change in the adjustment position. In order to describe the conventional flow rate adjustment method, FIGS. 6A to 6E only show the stopper 164, the arm 42A, and the support shaft 42B of the variable geometry turbocharger.

Figure 6A:
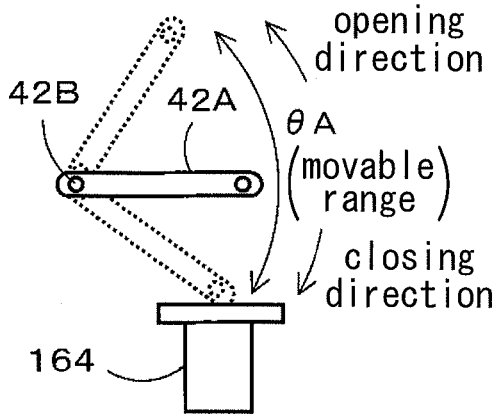
FIG. 6A Prior Art
FIG. 6A is a view of the stopper and an arm for showing a prior procedure of adjusting the flow rate of the variable geometry turbocharger.

FIG. 6A shows the movable range θA of the arm 42A and the stopper 164. The stopper 164 is installed in correspondence with the lower limit position of the arm 42A in a closing direction of the movable range θA. When the arm 42A approaches the stopper 164, the variable nozzles move in the closing direction. When the arm 42A moves away from the stopper 164, the variable nozzles move in an opening direction.

Figure 6B:
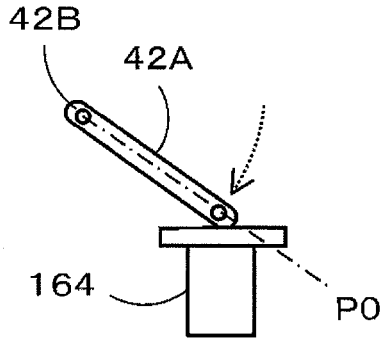
FIG. 6B Prior Art
FIG. 6B is a view of the stopper and the arm for showing the next step after FIG. 6A.

In the first step of flow rate adjustment, the stopper 164 is set at a temporary position. As shown in FIG. 6B, the operator drives the actuator 50 in the closing direction by the adjustment apparatus 80 such that the arm 42A moves to a position P0 where the arm 42A abuts the stopper 164. The adjustment apparatus 80 receives a detection signal from the opening detection sensor 51, and stores an opening amount based on the detection signal as the abutment position opening amount.

Figure 6C:
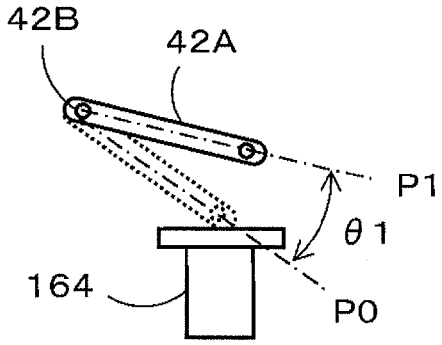
FIG. 6C Prior Art
FIG. 6C is a view of the stopper and the arm for showing the next step after FIG. 6B.

As shown in FIG. 6C, in the next step, the adjustment apparatus 80 moves the arm 42A by a predetermined angle θ1 causing the adjustment apparatus 80 to attain a pre-set first predetermined opening amount. Thereby the arm 42A moves to a temporary reference position P1. The first predetermined opening amount θ1 corresponds, for example, to a 0% opening position in terms of control. The adjustment apparatus 80 drives the actuator 50 in the open direction until the detection amount based on the detection signal from the opening detection sensor 51 becomes equal to the abutment position opening amount+the first predetermined opening amount.

Figure 6D:
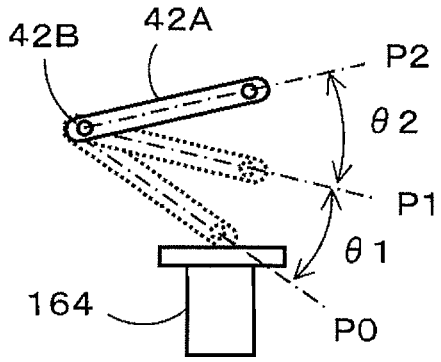
FIG. 6D Prior Art
FIG. 6D is a view of the stopper and the arm for showing the next step after FIG. 6C.

As shown in FIG. 6D, in the next step, the adjustment apparatus 80 moves the arm 42A by a pre-set second predetermined opening amount θ2. Thereby the arm 42A moves to a temporary reference position P2. The second predetermined opening amount θ2 corresponds, for example, to a 20% opening position in terms of control. The adjustment apparatus 80 drives the actuator 50 in the opening direction until the detection amount based on the detection signal from the opening detection sensor 51 becomes equal to the abutment position opening amount+the first predetermined opening amount+the second predetermined opening amount.

Next, the adjustment apparatus 80 operates the adjustment gas inflow apparatus 81. As a result, the adjustment gas flows into the variable geometry turbocharger 1, and the flow rate of the adjustment gas is measured based on the detection signal from the flow rate measurement sensor 83. The adjustment is complete when the measured flow rate is a flow rate within the proper predetermined range. This range corresponds to a temporary control position P2. Next, the operator seals the position adjustment portion of the stopper 164 so that the position of the stopper 164 may not be changed.

Figure 6E:
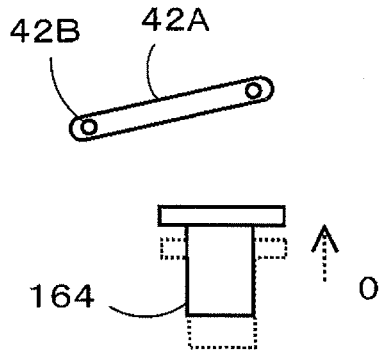
FIG. 6E Prior Art
FIG. 6E is a view of the stopper and the arm for showing the next step after FIG. 6D.

When the measured flow rate of the adjustment gas is not within the predetermined range, the procedure advances to the step shown in FIG. 6E, and the operator makes a small adjustment in the position of the stopper 164. It is convenient to prepare, in advance, a table or the like indicating the direction and amount of adjustment to be made of the position of the stopper 164 based on the difference between the actual flow rate measured and the proper flow rate. After the small adjustment of the position of the stopper 164, the step of FIG. 6B, the step of FIG. 6C, and the step of FIG. 6D are executed again. When, in the step of FIG. 6D, the flow rate measured is a flow rate within the proper predetermined range, the adjustment is completed, and the operator seals the position adjustment portion of the stopper 164.

In the conventional flow rate adjustment method, the steps of FIGS. 6B to 6D are executed again if the flow rate of the adjustment gas measured in the step of FIG. 6D is not within the predetermined range. Thus, the conventional flow rate adjustment method is rather disadvantageous in terms of efficiency. The stopper 164 requires a structure allowing small adjustments and a sealing structure allowing sealing. Thus, the stopper 164 is rather complicated. In the conventional flow rate adjustment method, it is necessary for the operator to make small positional adjustments to the stopper 164 and to seal the same. Thus, the flow rate adjustment method is rather difficult to execute.

In the flow rate adjustment method according to the present embodiment described below, there is no need to repeat the above-mentioned steps, which makes the method fairly efficient. Further, in the flow rate adjustment method according to the present embodiment, there is no need to make small adjustments to the stopper 64 or to seal the stopper 64. Accordingly, it is possible to manufacture the turbocharger 1 at a low cost.

Figure 4A:
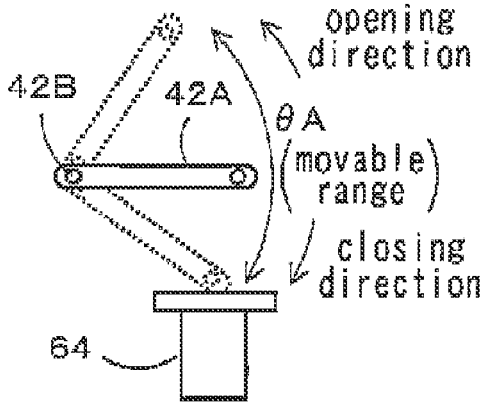
FIG. 4A PRIOR ART
FIG. 4A is a view of the stopper and an arm for showing a procedure of adjusting the flow rate of the variable geometry turbocharger.

A flow rate adjustment method according to the present embodiment will be described with reference to FIGS. 4A to 4E. In order to describe the flow rate adjustment method, only the stopper 64, the arm 42A, and the support shaft 42B are depicted in FIGS. 4A to 4E. FIG. 4A illustrates the movable range θA of the arm 42A and the stopper 64. The stopper 64 is arranged at the lower limit position of the arm 42A in the closing direction of the movable range. The stopper 64 of the present embodiment has no structure for making small positional adjustments. Thus, a portion of the stopper 64 which may abut the arm 42A is stationary.

Figure 4B:
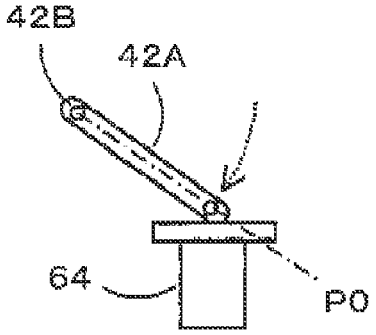
FIG. 4B PRIOR ART
FIG. 4B is a view of the stopper and the arm for showing the next step after FIG. 4A.

The first step in the flow rate adjustment method according to the present embodiment is an abutment position storage step shown in FIG. 4B. In the abutment position storage step, the operator operates the adjustment apparatus 80. The adjustment apparatus 80 rotates the actuator 50 in the closing direction, moving the arm 42A to the abutment position P0 where the arm 42A abuts the stopper 64. The adjustment apparatus 80 acquires a detection signal from the opening detection sensor 51, and stores an opening amount based on the detection signal as the abutment position opening amount.

Figure 4C:
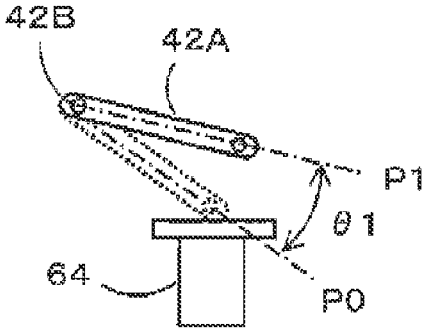
FIG. 4C PRIOR ART
FIG. 4C is a view of the stopper and the arm for showing the next step after FIG. 4B.

Next, as shown in FIG. 4C, a temporary control position movement step is executed. In the temporary control position movement step, the adjustment apparatus 80 moves the arm 42A by a pre-set first predetermined opening amount θ1. The arm 42A moves to a temporary reference position P1. The temporary reference position P1 corresponds, for example, to 0% opening position in terms of control. The adjustment apparatus 80 drives the actuator 50 in the opening direction until the detection amount based on the detection signal from the opening detection sensor 51 becomes equal to the abutment position opening amount+the first predetermined opening amount.

Figure 4D:
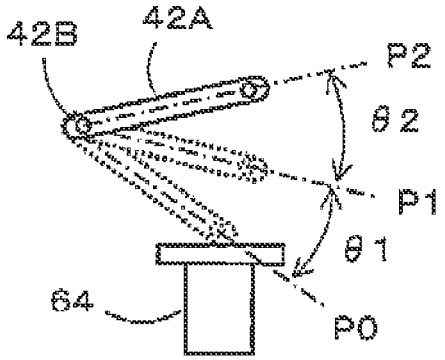
FIG. 4D PRIOR ART
FIG. 4D is a view of the stopper and the arm for showing the next step after FIG. 4C.

Next, as shown in FIG. 4D, the adjustment apparatus 80 moves the arm 42A by a pre-set second predetermined opening amount θ2. The arm 42A moves to a temporary control position P2. The temporary predetermined opening amount θ2 corresponds, for example, to a 20% opening amount in terms of control. The adjustment apparatus 80 drives the actuator 50 in the opening direction until the detection amount based on the detection signal from the opening detection sensor 51 becomes equal to a temporary control position opening amount, which is the abutment position opening amount+the first predetermined opening amount+the second predetermined opening amount.

It is also possible for the adjustment apparatus 80 to perform the operation of FIG. 4C and the operation of FIG. 4D through one operation. That is, it is possible for the adjustment apparatus 80 to move the arm 42A until the abutment position opening amount+a third predetermined opening amount (the third predetermined opening amount=the first predetermined opening amount+the second predetermined opening amount) is attained.

Next, in the state of FIG. 4D, a temporary control position flow rate storage step is executed. In the state of FIG. 4D, the arm 42A is situated at the temporary control position P2. In the temporary control position flow rate storage step, the adjustment apparatus 80 operates the adjustment gas inflow apparatus 81. As a result, the adjustment gas flows into the variable geometry turbocharger 1, and the flow rate measurement sensor 83 measures the flow rate of the adjustment gas based on a detection signal from the flow rate measurement sensor 83. The adjustment apparatus 80 stores the flow rate as a temporary control position flow rate.

Next, a correction amount calculation step is executed. In the correction amount calculation step, the adjustment apparatus 80 obtains a correction amount based on the difference between the temporary control position flow rate and a real control position flow rate. The real control position flow rate is the proper flow rate corresponding to the temporary control position opening amount (e.g., the 20% opening position). The real control position flow rate is previously stored in the adjustment apparatus 80.

Figure 4E:
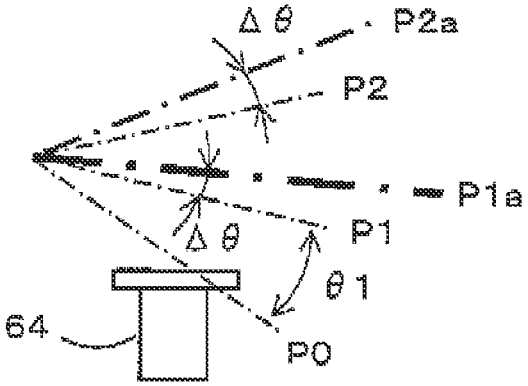
FIG. 4E is a view of the stopper showing the next step after FIG. 4D.

For example, as shown in FIG. 4E, a correction opening amount corresponding to a correction angle Δθ is obtained as the correction amount. It is desirable to previously prepare a table, map or the like for the conversion of the correction opening amount from the temporary control position flow rate and the real control position flow rate, and to store the same in the adjustment apparatus 80. This enables the adjustment apparatus 80 to easily obtain the correction opening amount.

As shown in FIG. 4E, the arm 42A moves from the temporary reference position P1 by the correction angle Δθ to thereby reach a real reference position P1*a*. The real reference position P1*a* is the proper position of the arm 42A, where the opening amount corresponds to the abutment position opening amount+the first predetermined opening amount. For example, the real reference position P1*a* is the proper position of the arm 42A corresponding to the 0% opening position in terms of control. The arm 42A moves from the temporary control position P2 by the correction angle Δθ to thereby reach a real control position P2*a*. The real control position P2*a* is the proper position of the arm 42A, where the opening amount corresponds to the abutment position opening amount+the first predetermined opening amount+the second predetermined opening amount. For example, the real control position P2*a* is the proper position of the arm 42A corresponding to the 20% opening position in terms of control.

Next, a correction information mounting step is executed. In the correction information mounting step, the operator records the obtained correction opening amount on a recording medium such as a barcode or a two-dimensional code. The correction opening amount is intrinsic correction information pertinent to the variable geometry turbocharger 1. The recording medium is mounted to the variable geometry turbocharger 1. In one example, the recording medium is attached to a correction recording portion previously provided on the variable geometry turbocharger 1.

Figure 7:
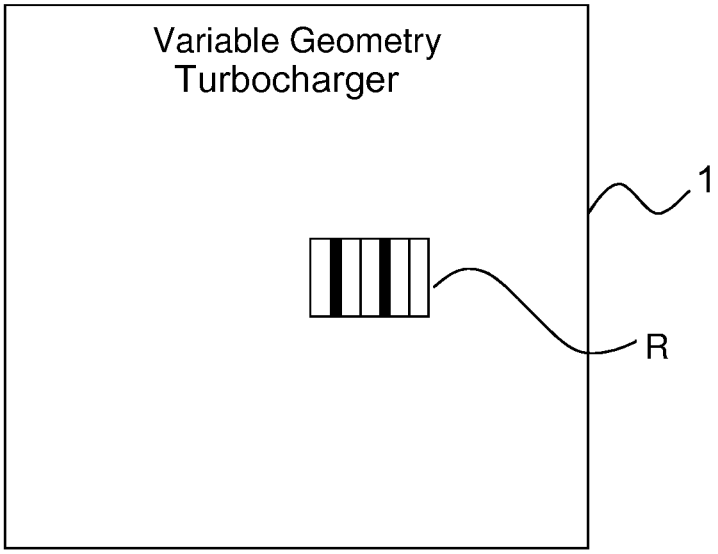
FIG. 7 is a schematic view of the recording medium.

Next, an in-vehicle mounting step is executed. In the in-vehicle mounting step, the operator causes the intrinsic correction information of the variable geometry turbocharger 1 to be stored in a control apparatus of a vehicle. As shown in FIG. 7, the intrinsic correction information is recorded on the recording medium R mounted to the variable geometry turbocharger 1. The intrinsic correction information, which is in the form of barcode or two-dimensional code data, is read by a code reader or the like, and is stored in the control apparatus 90. The operator mounts the control apparatus 90 and the variable geometry turbocharger in the vehicle 100, and connects, i.e. electrically connects, the control apparatus 90 to the opening detection sensor 51 and the actuator 50 of the variable geometry turbocharger 1, as shown in FIG. 1.

Next, a correction step is executed. In the correction step, the opening amount of the actuator 50 is corrected based on intrinsic correction information stored in the control apparatus.

The electric current applied to the actuator 50 and the opening amount of the variable nozzles 63 are in a substantially linear correlation. In the embodiment shown in FIGS. 4A to 4E, this correlation is utilized, and the correction amount calculated based on the difference between the flow rate at an arbitrary control opening amount and the proper flow rate is applied to all of the opening positions of the variable nozzles 63.

As compared with the conventional flow rate adjustment method, the method according to the embodiment shown in FIGS. 4A to 4E does not require repetition of steps. Thereby, the embodiment method is very efficient. There is no need to make small adjustments in the stopper 64 or to seal the stopper 64. It is only necessary for the stopper 64 to be capable of determining the position where the stopper 64 abuts the arm 42A, so that it is possible to reduce the setting time for the stopper 64.

As described above, the flow rate adjustment method includes a step of mounting the recording medium to the variable geometry turbocharger 1. Recorded on the recording medium R is the correction amount as intrinsic correction information pertinent to the variable geometry turbocharger 1. The operator causes the control apparatus to store the intrinsic correction information recorded on the recording medium R. As shown in FIG. 1, the control apparatus controls the actuator 50 such that the detection amount based on the detection signal from the opening detection sensor 51 becomes equal to a detection amount corresponding to a target opening. The control apparatus is connected to the actuator 50 and the opening detection sensor 51, and the control apparatus corrects the opening of the variable nozzles based on the intrinsic correction information.

As a result, the variable geometry turbocharger 1 can be appropriately operated without depending on the individual differences of the variable geometry turbocharger 1.

The variable geometry turbocharger 1 can be adjusted by using the above-described flow rate adjustment method. Thus, the variable geometry turbocharger 1 can be efficiently adjusted.

The stopper 64 has no structure for adjusting the portion abutting the arm 42A, and the portion abutting the arm 42A is fixed. Thus, the stopper 64 is formed in a simple construction. It is possible to reduce the number of components of the variable geometry turbocharger 1.

Figure 5A:
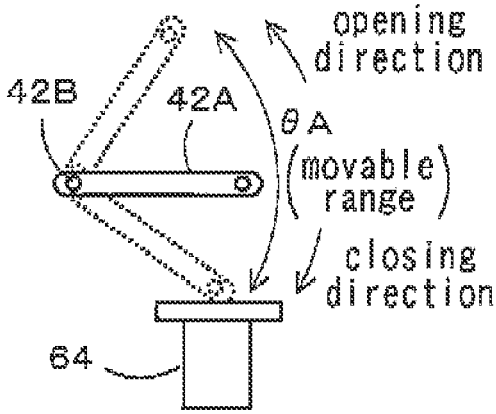
FIG. 5A is a view of the stopper and the arm for showing another procedure of adjusting the flow rate of the variable geometry turbocharger.

Instead of the method shown in FIGS. 4A to 4E, it is also possible to adopt a flow rate control method as shown in FIGS. 5A to 5D. In FIGS. 5A to 5D, only the stopper 64, the arm 42A, and the support shaft 42B are depicted. FIG. 5A shows the movable range OA of the arm 42A and the stopper 64. The stopper 64 is arranged at the lower limit position of the arm 42A in the closing direction of the movable range. The stopper 64 has no structure for allowing small positional adjustments, and the portion where the stopper 64 abuts the arm 42A is fixed.

Figure 5B:
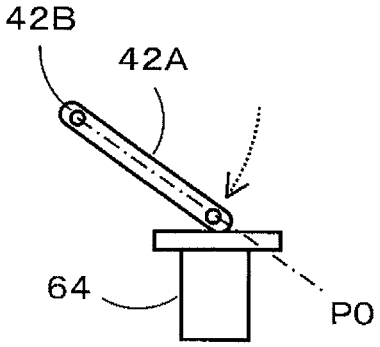
FIG. 5B is a view of the stopper and the arm for showing the next step after FIG. 5A.

The first step in flow adjustment is an abutment position storage step shown in FIG. 5B. The abutment position storage step shown in FIG. 5B is the same as that shown in FIG. 4B, so a description thereof will be left out.

Figure 5C:
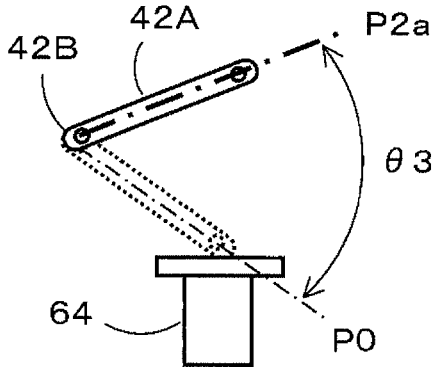
FIG. 5C is a view of the stopper and the arm for showing the next step after FIG. 5B.

Next, a real control position storage step shown in FIG. 5C is executed. In the real control position storage step, the adjustment apparatus 80 operates the adjustment gas inflow apparatus 81, and the adjustment gas flows into the variable geometry turbocharger 1. The adjustment apparatus 80 moves the arm 42A while measuring the flow rate of the adjustment gas based on the detection signal from the flow rate measurement sensor 83. The adjustment apparatus 80 drives the actuator 50 in the opening direction until the flow rate of the adjustment gas becomes equal to a real control position flow rate, and moves the arm 42A to a real control position P2*a*. The real control position flow rate has been determined ahead of time. The real control position flow rate is the proper flow rate corresponding to the temporary control position opening amount. The temporary control position opening amount is equal to the abutment position opening amount+the first predetermined opening amount+the second predetermined opening amount (for example 0% opening amount+20% opening amount=20% opening amount). When the flow rate of the adjustment gas becomes equal to the real control position flow rate, the arm 42A is situated at the real control position P2*a*. At this time, the adjustment apparatus 80 stores the detection amount based on the detection signal from the opening detection sensor 51 as the real control position opening amount.

Next, a correction amount calculation step is executed. In the correction amount calculation step, the adjustment apparatus 80 obtains the correction amount based on the difference between the temporary control position opening amount (the abutment position opening amount+the first predetermined opening amount+the second predetermined opening amount) and the real control position opening amount.

Figure 5D:
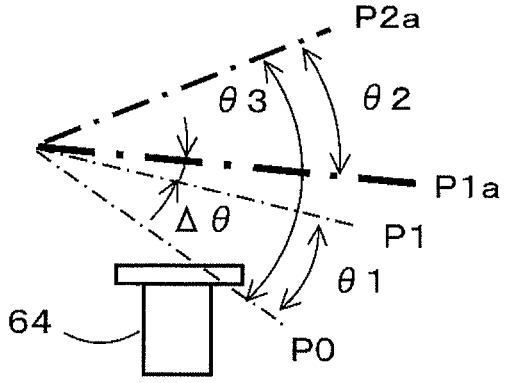
FIG. 5D is a view of the stopper showing the next step after FIG. 5C.

For example, as shown in FIG. 5D, the adjustment apparatus 80 obtains a correction opening amount (correction amount) corresponding to a correction angle Δθ. It is desirable to previously prepare a table, map or the like for the conversion of the correction opening amount from the difference between the temporary control position opening amount and the real control position opening amount, and to store the same in the adjustment apparatus 80. This enables the adjustment apparatus 80 to easily obtain the correction opening amount.

As shown in FIG. 5D, the real reference position P1*a* is a position attained by moving the arm 42A from the temporary reference position P1 by Δθ. The temporary reference position P1 is a position attained by moving the arm 42A in the opening direction by a predetermined angle θ1 corresponding to the first predetermined opening amount from the abutment position P0. The real reference position P1*a* is the proper position for the arm 42A corresponding to the abutment position opening amount+the first predetermined opening amount (=the temporary reference position P1). Alternatively, the real reference position P1*a* is a position attained by moving the arm 42A in the closing direction by a predetermined angle θ2 from the real control position P2*a*. The predetermined angle θ2 is an angle corresponding to the second predetermined opening amount.

The correction information mounting step, the in-vehicle mounting step, and the correction steps to be executed from here onward are the same as those of the above-described embodiment, so descriptions of those steps will be left out.

As compared with the conventional flow rate adjustment method, the method according to the embodiment shown in FIGS. 5A to 5D does not require the repetition of steps. Thus the embodiment method is very efficient. Further, there is no need to make small adjustments with respect to the stopper 64 or to seal the stopper 64. It is only necessary for the stopper 64 to be capable of determining the position where the stopper 64 abuts the arm 42A, so that it is possible to reduce the setting time for the stopper 64.

While the embodiments of invention have been described with reference to specific configurations, it will be apparent to those skilled in the art that many alternatives, modifications and variations may be made without departing from the scope of the present invention. Accordingly, embodiments of the present invention are intended to embrace all such alternatives, modifications and variations that may fall within the spirit and scope of the appended claims. For example, embodiments of the present invention should not be limited to the representative configurations, but may be modified, for example, as described below.

As described above, the stopper 64 may be situated so as to correspond to the closing direction lower limit position of the arm 42A, or may be situated so as to correspond to the lower limit position of one of the power transmission members. Alternatively, it is also possible for the stopper 64 to be situated so as to abut one of the power transmission members when the variable nozzles 63 are driven in the opening direction. For example, when the actuator 50 is rotated in the opening direction, a power transmission member abuts the stopper 64, whereby the opening direction upper limit position is determined. In controlling the opening amount of the variable nozzles 63, it is possible to control the opening amount of the variable nozzles 63 based on the upper limit position.

As described above, the correction opening amount may be calculated from the difference between the temporary control position flow rate and the real control position flow rate when the flow rate corresponds to the 20% opening amount in terms of control. Alternatively, the respective correction opening amounts may be calculated for a plurality of opening amounts in terms of control.

As described above, it is possible for the operator to input the correction amount to a recording medium preparation apparatus, causing the apparatus to prepare a recording medium in the form of a barcode or the like. Alternatively, it is also possible to connect the recording medium preparation apparatus to the adjustment apparatus 80, causing the recording medium preparation apparatus to prepare the recording medium based on a signal from the adjustment apparatus 80.

As described above, the recording medium may be a barcode or the like, or an electrical component incorporated into the turbocharger. The electrical component may be connected to the adjustment apparatus 80, and store the correction amount based on an electric signal from the adjustment apparatus 80. The electrical component may be connected to the control apparatus through the connection between the turbocharger and the control apparatus of the vehicle, transmitting an electric signal related to the correction amount to the control apparatus.

This invention claimed is:

1. A method for adjusting a variable nozzle associated with a variable geometry turbocharger to regulate flow into the variable geometry turbocharger, comprising the steps of:

driving an actuator of the turbocharger by an adjustment apparatus that is electrically connected to the actuator to an abutment position defined as where a connecting rod meets a stopper, wherein the connecting rod connects the actuator to a variable nozzle;

detecting opening of the variable nozzle when the connecting rod is at the abutment position by an opening detection sensor that is electrically connected to the adjustment apparatus;

acquiring and storing information regarding an abutment position opening amount by the adjustment apparatus based on a detection signal from the opening detection sensor;

adjusting an opening of an exhaust gas flow path to an exhaust turbine of the variable geometry turbocharger by the variable nozzle;

continuing to drive the actuator until a detection amount based on the detection signal from the opening detection sensor matches a set temporary control position opening amount of the variable nozzle as defined by the connecting rod such that the connecting rod moves to a temporary control position;

allowing adjustment gas to flow into the exhaust gas flow path by an adjustment gas inflow apparatus, wherein the adjustment gas inflow apparatus is connected to the exhaust gas flow path and is electrically connected to the adjustment apparatus;

acquiring and storing a temporary control position flow rate by using a flow rate measurement sensor, wherein the temporary control position flow rate is a flow rate of the adjustment gas when the connecting rod is at the temporary control position, measuring the flow rate of the adjustment gas by the flow rate measurement sensor;

determining a correction control positioning opening amount for the variable nozzle by the adjustment apparatus based on a difference in value between the temporary control position flow rate and a real control position flow rate, wherein the real control position flow rate is in relation to the set temporary control position opening amount of the variable nozzle;

recording the correction control positioning opening amount for the variable nozzle on a recording medium;

mounting the recording medium to the variable geometry turbocharger;

detaching the variable geometry turbocharger from the adjustment apparatus and the adjustment gas inflow apparatus;

mounting the variable geometry turbocharger on the vehicle and connecting the variable geometry turbocharger to an engine of the vehicle so that an exhaust gas from the engine flows into the variable geometry turbocharger;

storing the correction control positioning opening amount recorded on the recording medium in an control apparatus mounted on the vehicle, the control apparatus being in electrical communication with the vehicle-mounted variable geometry turbocharger, and controlling the actuator of the variable geometry turbocharger to correct the opening amount of the variable nozzle by the vehicle-mounted control apparatus based on the correction control positioning opening amount.

2. A method for adjusting a variable nozzle associated with a variable geometry turbocharger to regulate flow into the variable geometry turbocharger, comprising the steps of:

driving an actuator of the variable geometry turbocharger by an adjustment apparatus that is electrically connected to the actuator to an abutment position defined as where a connecting rod abuts a stopper, wherein the connecting rod connects the actuator to a variable nozzle;

detecting opening of the variable nozzle when the connecting rod is at the abutment position by an opening detection sensor that is electrically connected to the adjustment apparatus, acquiring and storing information regarding an abutment position opening amount by the adjustment apparatus based on a detection signal from the opening detection sensor;

adjusting an opening of an exhaust gas flow path to an exhaust turbine of the variable geometry turbocharger by the variable nozzle;

continuing to drive the actuator until a flow rate measured by a flow rate measurement sensor matches a flow rate corresponding to a set temporary control position opening amount of the variable nozzle as defined by the connecting rod such that the connecting rod moves to a real control position;

allowing the adjustment gas to flow into the exhaust turbine by an adjustment gas inflow apparatus, wherein the adjustment gas inflow apparatus is connected to the exhaust gas flow path and is electrically connected to the adjustment apparatus;

measuring the flow rate of the adjustment gas by the flow rate adjustment measurement sensor;

acquiring and storing a real control position opening amount by the adjustment apparatus based on a detection signal from the opening detection sensor when the connecting rod is at the real control position;

determining a correction control positioning opening amount for the variable nozzle by the adjustment apparatus based on a difference in value between the temporary control position opening amount and the real control position opening amount of the variable nozzle;

recording the correction control positioning opening amount for the variable nozzle on a recording medium;

mounting the recording medium to the variable geometry turbocharger;

detaching the variable geometry turbocharger from the adjustment apparatus and the adjustment gas inflow apparatus;

mounting the variable geometry turbocharger on the vehicle and connecting the variable geometry turbocharger to an engine of the vehicle so that an exhaust gas from the engine flows into the variable geometry turbocharger;

storing the correction control positioning opening amount recorded on the recording medium in the control apparatus mounted on the vehicle, the control apparatus being in electrical communication with the vehicle-mounted variable geometry turbocharger, and controlling the actuator of the variable geometry turbocharger to correct the opening amount of the variable nozzle by the vehicle-mounted control apparatus based on the correction control positioning opening amount.

* * * * *